US007373734B1

(12) United States Patent
Givonetti

(10) Patent No.: US 7,373,734 B1
(45) Date of Patent: May 20, 2008

(54) LINEAR PROPORTIONER

(76) Inventor: Raymond Givonetti, 12622 Woodcove La., Knoxville, TN (US) 37922

( * ) Notice: Subject to any disclaimer, the term of this patent is extended or adjusted under 35 U.S.C. 154(b) by 0 days.

(21) Appl. No.: 11/833,798

(22) Filed: Aug. 3, 2007

(51) Int. Cl.
*B43L 9/08* (2006.01)

(52) U.S. Cl. ..... 33/663; 33/558.02; 33/432; 33/18.3; 33/23.01

(58) Field of Classification Search ..... 33/663–664, 33/558.02, 558.04, 558.05, 558.2, 432, 434, 33/455, 465, 1 K, 18.3, 25.1, 23.01, 23.04, 33/23.06, 23.07, 23.08
See application file for complete search history.

(56) References Cited

U.S. PATENT DOCUMENTS 967,267 A 8/1910 Thompson
2,560,697 A 7/1951 Joy
2,645,021 A 7/1953 Diekes
2,770,884 A 11/1956 Eckert
3,858,324 A 1/1975 Padowicz
4,416,063 A 11/1983 Nestor
4,586,265 A * 5/1986 Hopkins et al. ..... 33/432
5,154,004 A 10/1992 Allen
7,043,849 B1 5/2006 Leger
2003/0014876 A1* 1/2003 Goldie ..... 33/558.02

* cited by examiner

*Primary Examiner*—Yaritza Guadalupe-McCall
(74) *Attorney, Agent, or Firm*—Pitts & Brittian PC

(57) ABSTRACT

A linear proportioner including a logarithmic mechanism to be used for transferring linear dimensions from an existing drawing, picture or actual scene to a new drawing or artist medium. An elongated assembly provides two indicators (one fixed and one variable) as reference pointers, two indicators (one fixed and one variable) for object pointers and an adjustment knob which, when rotated, moves the variable indicators synchronously and proportionally. By depressing the knob when transferring the first object dimension, the proportion ratio (transparent to the operator) is automatically set for subsequent dimension transfers.

7 Claims, 5 Drawing Sheets

LINEAR PROPORTIONER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

The present invention pertains to the field of Linear Proportioners. More particularly, this invention is intended to assist an artist or drawing person to easily obtain more precise proportions by transferring dimensions from an actual scene, a photograph or any reference picture to any drawing or artist medium.

2. Description of the Related Art

Linear proportioners have been known as proportional dividers, pantographs, and proportion calipers. Proportional dividers have two similar members or legs where the distal ends of both members are pointers. The two members are connected by an adjustable pivot assembly forming a scissor-like device. When the pivot is fixed in one position, the dimension between the upper and lower pointers provide a constant ratio of those dimensions independent of the scissor opening. Therefore, dimensions on a drawing can be transferred to another drawing with the same ratio or proportion.

Pantographs are four member devices designed to permit tracing lines on a reference drawing or picture in the same plane where an object drawing is generated (usually expanded). The distal end of one member is fixed to the drawing plane with a pivot. The distal end of a different member is a stylus for tracing. The distal end of another member provides a mounting for a writing implement. The object drawing is generated with a constant ratio to the reference drawing, i.e. in proportion.

One type of proportional caliper is known as the golden proportional caliper. This device is a threaded spindle having opposite end sections with reverse threads of different pitches. The ratio of these pitches is 1 to 0.618. Where the two different threads meet there is a fixed reference pointer. At each end of the spindle there is a variable pointer. The two distances between the reference pointer and the variable pointers maintain a ratio of 1 to 0.618.

Proportional dividers and calipers are well suited for there intended design in the drafting environment. Extending the application of these devices to art environments such as canvas and easel can be awkward because of the dynamic dimension range and the physical configuration of the device. Also, in a drafting environment, an expanded or reduction of a drawing is desired using a particular ratio; it is not necessary for an Artist to utilize ratios, mathematics or actual dimensions when transferring a scene or photograph to art medium.

Other devices have been developed to overcome these and similar problems associated with . . . . Typical of the art are those devices disclosed in the following U.S. patents:

| U.S. Pat. No. | Inventor(s) | Issue Date |
|---|---|---|
| 967,267 | J. C. Thompson | Aug. 16, 1910 |
| 2,560,697 | J. F. Joy | Dec. 16, 1946 |
| 2,645,021 | M. T. Diekes | Jul. 14, 1953 |
| 2,770,884 | J. F. Eckert | Nov. 20, 1956 |
| 3,858,324 | M. Padowicz | Jan. 7, 1975 |
| 4,416,063 | J. Nestor | Nov. 22, 1983 |
| 5,154,004 | J. Allen | Oct. 13, 1992 |
| 7,043,849 | D. Leger | May 16, 2006 |

Of these patents, Thompson, in the '267 patent discloses a "Proportional Measuring Instrument" which can be used as a linear proportioner commonly known as a "proportional divider". The object of the invention is to facilitate the operation of comparing linear dimensions, dividing lines proportionally, adding to a line a given proportion of that line and the instantaneous conversion linear units such as inches and meters. The configuration of this invention is similar to other proportional dividers. It consists of two similar legs connected in a scissor like fashion by an adjustable pivot assembly. Distal ends of both legs are pointers. By fixing the position of the pivot assembly, the distance between the upper leg pointers divided by the distance of the lower leg pointers will be a ratio independent of the angle between the legs. Given this constant ratio, this device can transfer linear dimensions of a drawing to a new drawing with respective proportions. In addition the '267 device has a third member connected near the ends of one set of pointers which is a measuring device for the distance between those pointers.

The '697 patent issued to Joy discloses a "Proportional Divider" configured with two similar legs by a slidable pivot assembly. Distal ends of both legs are pointers. By fixing the position of the pivot assembly, the distance between the upper leg pointers divided by the distance of the lower leg pointers will be a ratio independent of the angle between the legs. Given this constant ratio, the '697 device is provided for transferring linear dimensions of a drawing to a new expanded or reduced drawing.

The '021 patent issued to Diekes is also a "Proportional Divider" configured with two similar legs by an adjustable pivot assembly. Distal ends of both legs are pointers. By fixing the position of the pivot assembly, the distance between the upper leg pointers divided by the distance of the lower leg pointers will be a ratio independent of the angle between the legs. Given this constant ratio, the '021 device is provided for transferring linear dimensions of a drawing to a new expanded or reduced drawing.

Eckert, in the '884 patent, discloses a proportional divider configured with two similar legs and having a slidable pivot assembly. Distal ends of both legs are pointers. By fixing the position of the pivot assembly, the distance between the upper leg pointers divided by the distance of the lower leg pointers will be a ratio independent of the angle between the legs. Given this constant ratio, the '884 device is provided for transferring linear dimensions of a drawing to a new expanded or reduced drawing.

The '324 patent issued to Padowicz is a pantograph which is used to reproduce (usually enlarge) a picture or drawing by tracing lines on the reference drawing. The reference drawing and the object drawing are in the same plane where one member of a four-member apparatus is affixed to this plane via a pivot. The distal end of a second member has a stylus mounted for tracing. The distal end of a third member has a mounting for a writing implement. The four members are interconnected by pivots which maintain a constant proportion for reproduction.

The '063 patent issued to Nestor et al., and entitled, "Golden Proportion Calipers" discloses a device including a threaded spindle having opposite end sections with reverse threads of different pitches. As discussed above, the ratio of these pitches is 1 to 0.618. Where the two different threads meet there is a fixed reference pointer. At each end of the spindle there is a variable pointer. The two distances between the reference pointer and the variable pointers maintain a ratio of 1 to 0.618.

Allan, in the '004 patent, discloses a "Proportional Divider" configured with two similar legs and having a slidable pivot assembly. Distal ends of both legs are pointers. By fixing the position of the pivot assembly, the distance between the upper leg pointers divided by the distance of the lower leg pointers will be a ratio independent of the angle between the legs. Given this constant ratio, the '004 device is provided for transferring linear dimensions of a drawing to a new expanded or reduced drawing.

The '849 patent issued to Leger, and entitled "Multifunctional Caliper Instrument for the Arts," is similar in configuration to a pantograph in that it has four members interconnected by pivots. There are four pointers at distal ends of three members. The '849 patent describes various uses for the invention. One application is a proportional divider where two of the four members are removed. The remaining two members are functionally similar to the proportional dividers above.

BRIEF SUMMARY OF THE INVENTION

A linear proportioner for transferring dimensions from a subject graphic to a medium using a logarithmic scale is disclosed. The dimensions are proportioned, expanded or reduced, using the natural logarithm function. The linear proportioner is provided for a user such as an artist to more accurately transfer an image such as a portrait or a landscape onto a canvas, for example.

The linear proportioner includes a housing defining an elongated structure and having proximal and distal ends. A pair of cooperating rotating rods is rotatably received within the housing. The housing defines a first channel and a second channel for receiving the first and second rods, respectively. Each of the first and second channels is configured to rotatably receive one of the rods and to slidably receive a variable pointer. The housing includes proximal and distal end caps on which the proximal and distal ends of the rods are rotatably mounted, respectively.

Each of the housing first and second channels is configured to define three interconnected channels. Specifically, a rod channel, a guide channel, and a pointer channel are defined. Each of the first and second rods is provided with a pair of dedicated pointers, including a fixed pointer and a variable pointer. Each fixed pointer is fixed relative to its respective rod. Each variable pointer engages its respective rod such that as the rod is rotated, the variable pointer moves in a linear path toward or away from its respective fixed pointer. Each variable pointer defines a bearing pin defined to be received within the groove. Each of the variable pointers further defines a guide for limiting movement of the pointer in a direction parallel to the longitudinal axes of the rods. The bearing pin extends away from the guide in one direction. An extended portion is defined by each variable pointer and extends from the guide in a direction substantially opposite that of the bearing pin. The extended portion defines the pointer which is received in the pointer channel.

A calibration mechanism is provided for calibrating the linear proportioner. In general, a distance between a fixed pointer and variable pointer pair is set with respect to the corresponding rod. In practice, either of the rods and associated pair of pointers may be used as the reference for calibration. The distance between the one pair of pointers is set to a reference measurement. The calibration mechanism is then engaged and the distance between the other pair of pointers is set to a desired distance corresponding to the desired dimension between the same two reference points to be transferred to the target medium, without adjusting the reference distance between the first pair of pointers.

The calibration mechanism includes a cooperating set of gears disposed at the proximal end of the housing. First and second gears are disposed on the proximal end of the first and second rods respectively. A third gear is carried by the housing and is disposed to cooperatively engage each of the first and second gears. The third gear is selectively disengageable from at least one of the first and second gears. When the third gear is engaged with each of the first and second gears, when one of the first and second rods is rotated, the other of the first and second rods is rotated in the same direction and at the same rate. When the third gear is disengaged from at least one of the first and second gears, either of the first and second rods is rotatable without imparting rotation of the other of the first and second rods.

A gear cover is provided to enclose each of the first, second, and third gears. The third gear is carried on a shaft having a proximal end extending through a through opening defined in the gear cover, and a distal end extending through a through opening defined by the housing proximal end cap. An adjustment knob is carried on the proximal end of the shaft and is provided for rotating the first and second rods and for depressing the shaft to disengage the third gear from at least one of the first and second gears. The shaft is normally biased toward the gear cover such that the third gear is in engagement with each of the first and second gears. A spring disposed between the third gear and the housing proximal end. In order to limit the travel of the shaft toward the gear cover, a limit is carried on or defined by the shaft between the third gear and the gear cover. When the adjustment knob is depressed, the compression spring is compressed, and when the adjustment knob is released, the compression spring expands to return the third gear to engage both of the first and second gears.

In order to accomplish disengagement with only the second gear, the first gear defines a thickness equal to the thickness of the second gear plus the distance of travel of the third gear. The third gear defines a thickness substantially equal to the thickness of the second gear. The length of travel of the third gear is at least equal to the thickness of the second and third gears, thus allowing the disengagement of the second and third gears. When the third gear is disengaged from the second gear, it is rotated by rotating the adjustment knob in order to rotate the first rod independently of the second rod. To calibrate the linear proportioner, the reference measurement is set on the second pair of pointers by rotating the adjustment knob. The adjustment knob is then depressed and then rotated in order to set the distance between the first pair of pointers to the target measurement. The adjustment knob is then released. For subsequent measurements, the distance between the second pair of pointers is set to the measurement between any two points on the subject by rotating the adjustment knob. The distance between the first pair of pointers is then transferred to the target medium, the proportion between the subsequent reference and target measurements being the same as the proportion between the initial reference and target measurement.

In order to move each of the variable pointers, each variable pointer engages its respective rod. Each of the pair of rods defines a narrow groove dimensioned to closely and slidably receive a variable pointer bearing pin and encircling the rod and traversing the length of the rod in spiral fashion. The groove is a graphical representation of the function N[ln x] superimposed about the cylindrical surface of each of the pair of rods, where N is a constant, ln is the natural log function, and x is the distance along the length of the rod.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
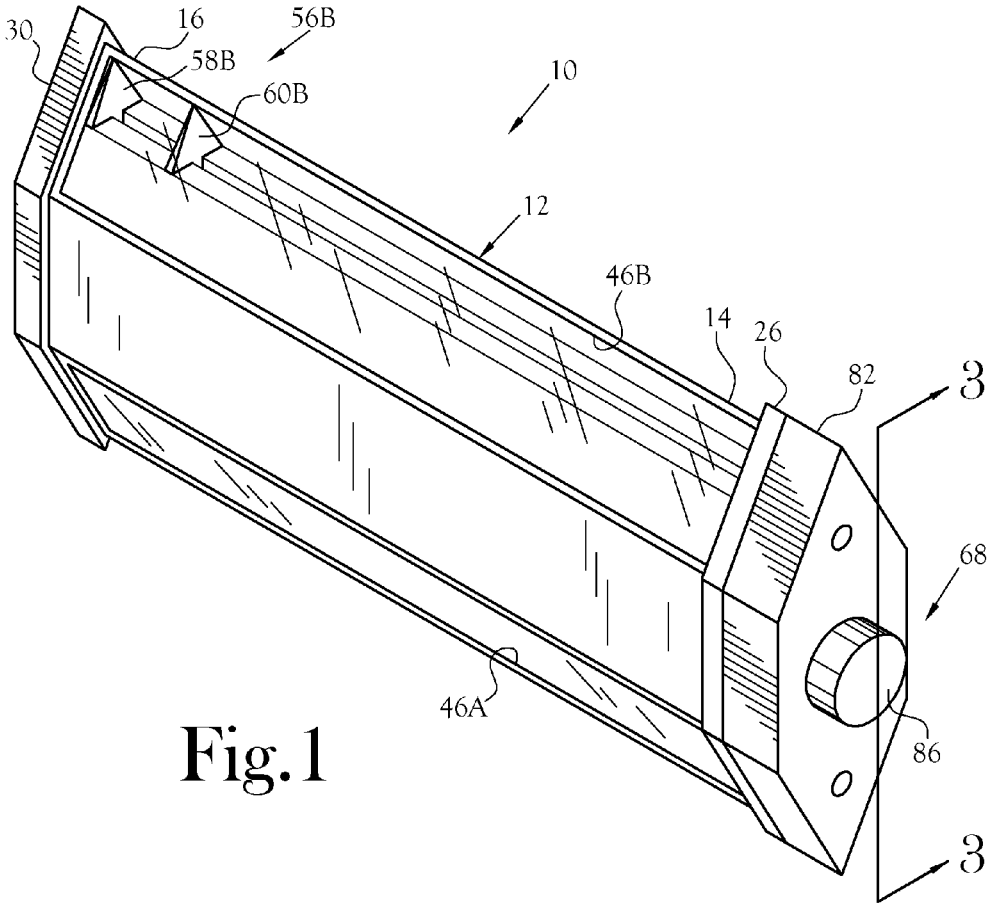
FIG. 1 is a perspective view of a linear proportioner constructed in accordance with several features of the present invention.

A linear proportioner for transferring dimensions from a subject graphic to a medium is disclosed. The linear proportioner of the present invention is designed to transfer proportional dimensions using a logarithmic scale. Using the configuration and the functionality of the present invention, dimensions are proportioned, expanded or reduced, using the natural logarithm function. The linear proportioner is illustrated generally at 10 in the figures, and is provided for a user such as an artist to more accurately transfer a subject or image 98 such as a portrait or a landscape onto a target medium 100 such as a canvas, for example. For use in transferring dimensions from a portrait, the distance between two points on the subject 98 is measured and an accurate proportion is then transferred to the medium 100. For a landscape, the distance between to points is visually measured.

In the following description of the invention, various elements are identical to each other and denoted with a numeral and the "A" or "B" when referred to specifically. However, when referred to generically, the elements are referred to only with the numeral. In the drawings, the elements are typically illustrated using the "A" and "B" suffixes. Therefore, when referred to without the "A" or "B" suffixes, it is intended that the both of the elements "A" and "B" are being referenced in the appropriate drawings.

Figure 2:
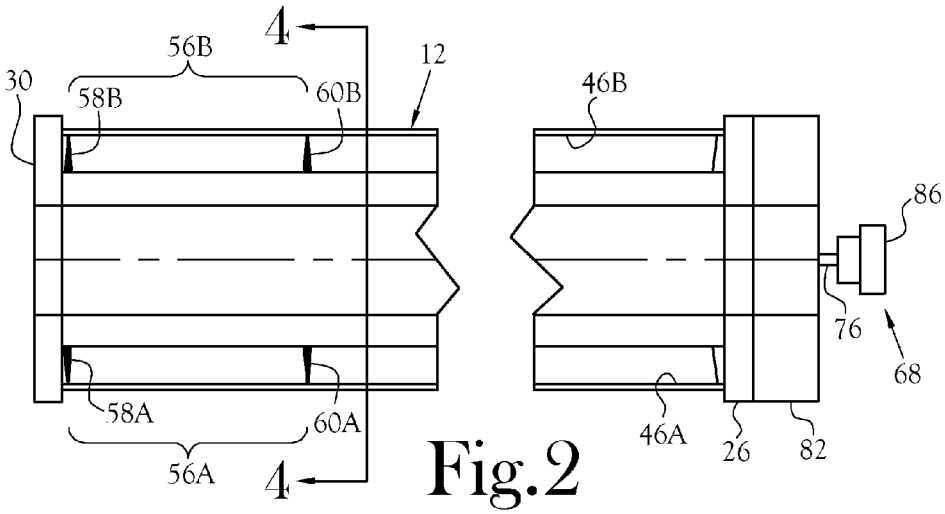
FIG. 2 is a front elevation view of the linear proportioner of FIG. 1.

FIGS. 1 and 2 illustrate a perspective and front elevation view of the linear proportioner 10 of the present invention. The linear proportioner 10 includes a housing 12 defining an elongated structure and having proximal and distal ends 14, 16. A pair of cooperating rotating rods 48A, 48B is rotatably received within the housing 12. In the illustrated embodiment, the housing 12 defines a first channel 18A and a second channel 18B for receiving the first and second rods 48A, 48B, respectively. Each of the first and second channels 18A, 18B is configured to rotatably receive one of the rods 48A, 48B and, as will be discussed further below, to slidably receive a variable pointer 60A, 60B. The housing 12 includes proximal and distal end caps 26, 30. The proximal ends 50 of the rods 48 are rotatably mounted on the proximal end cap 26, and the distal ends 52 of the rods 48 are rotatably mounted on the distal end cap 30.

Figure 3:
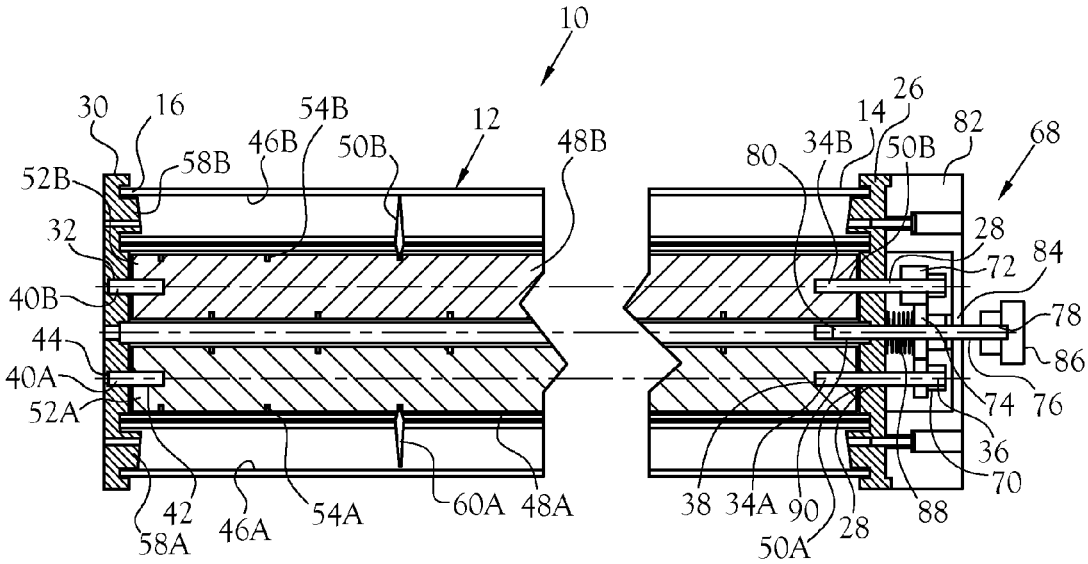
FIG. 3 is a front elevation view of the linear proportioner, in cross-section taken along lines 3-3 of FIG. 1.

FIG. 3 is a front elevation, in section, of the linear proportioner 10. In this figure, it is best illustrated that the rods 48 are rotatably mounted on the end caps 26, 30 in a conventional manner, such as with the illustrated pins 34, 40. In the illustrated embodiment, a first proximal end pin 34A is carried on the proximal end 50A of the first rod 48A, and a first distal end pin 40A is carried on the distal end 52A of the first rod 48A. Similarly, a second proximal end pin 34B is carried on the proximal end 50B of the second rod 48B, and a second distal end pin 40B is carried on the distal end 52B of the second rod 48B. The proximal end cap 26 defines first and second through openings 28A, 28B for receiving the first and second proximal end pins 34A, 34B, respectively, such that a distal end 38 of each pin 34 extends from the proximal end cap 26. The distal end cap 30 defines first and second recesses 32A, 32B for receiving the distal ends 44A, 44B of the first and second distal end pins 40A, 40B. The distal end pins 40 and the recesses 32 are configured such that when the distal end pins 40 are received within the recesses 32, a clearance is defined between the first and second rod distal ends 52A, 52B and the distal end cap 30 in order to facilitate rotation of the rods 48 within the housing 12.

Each of the first and second rods 48A, 48B is provided with a pair of dedicated pointers 56A, 56B. Each pair of pointers 56 includes a fixed pointer 58 and a variable pointer 60. Each fixed pointer 58 is fixed relative to its respective rod 48. Each variable pointer 60 engages its respective rod 48 such that as the rod 48 is rotated, the variable pointer 60 moves in a linear path toward or away from its respective fixed pointer 58. Each variable pointer 60 defines a bearing pin 62 defined to be received within a groove 54 defined by each rod 48, as described in greater detail below. Each of the variable pointers 60 further defines a guide 64 for limiting movement of the pointer 60 in a direction parallel to the longitudinal axes of the rods 48. The bearing pin 62 extends away from the guide 64 in one direction. An extended portion 66 is defined by each variable pointer 60 and extends from the guide 64 in a direction substantially opposite that of the bearing pin 62. The extended portion 66 defines the visible portion of the variable pointer 60.

Figure 4:
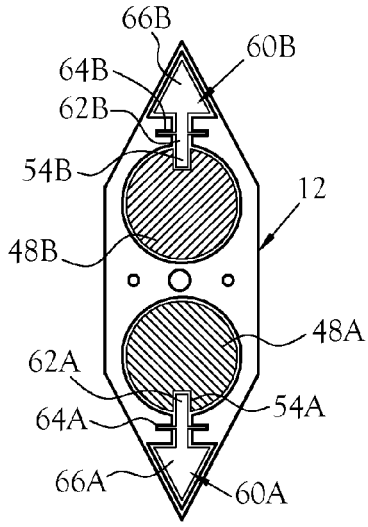
FIG. 4 illustrates an end view of the linear proportioner, in cross-section taken along lines 4-4 of FIG. 2.

As illustrated in FIG. 4, the housing first and second channels 18A, 18B are configured to define three interconnected channels. Specifically, each channel 18 defines a rod channel 20, a guide channel 22, and a pointer channel 24. The guide 64 of each of the variable pointers 60 is configured to be closely and slidably received within the guide channel 22. The bearing pin 62 extends away from the guide 64, toward the rod 48 and into the groove 54 defined by the rod 48. The extended portion 66 of each variable pointer 60 extends away from the guide 64 and into the pointer channel 24. The housing 12 defines first and second windows 46A, 46B coincident with and in order to view the first and second pairs of pointers 56A, 56B. Each window 46 is defined in any number of ways, including but not limited to an opening or transparent portion defined in the housing 12.

Figure 5A:
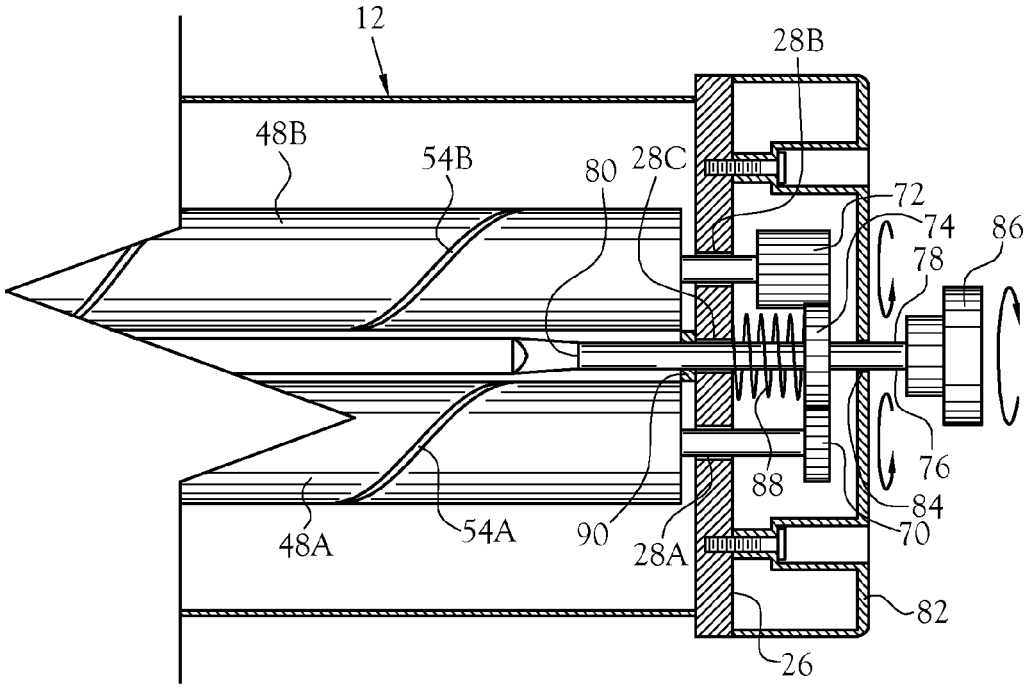
FIG. 5A is an enlarged partial front elevation view of the linear proportioner, in cross-section taken along lines 3-3 of FIG. 1, illustrating the third gear engaged with each of the first and second gears, and further illustrating the relative movement of the first and second gears and the first and second variable pointers as the adjustment knob is rotated to impart rotation on the third gear.
Figure 5B:
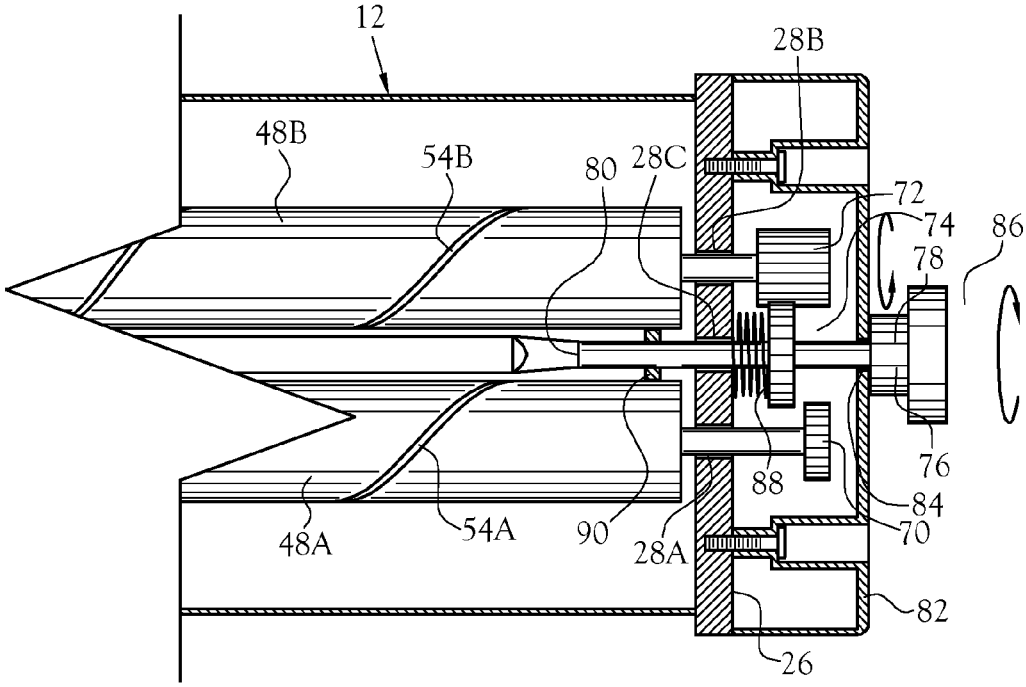
FIG. 5B is an enlarged partial front elevation view of the linear proportioner, in cross-section taken along lines 3-3 of FIG. 1, illustrating the adjustment knob being depressed such that the third gear is engaged only with the first gear, and further illustrating the relative movement of the first gear and the first variable pointer as the adjustment knob is rotated to impart rotation on the third gear.

As illustrated in FIGS. 5A and 5B, a calibration mechanism 68 is provided for calibrating the linear proportioner 10. In general, a distance between a fixed pointer and variable pointer pair 56 is set with respect to the corresponding rod 48. In practice, either of the rods 48 and associated pair of pointers 56 may be used as the reference for calibration. However, for purposes of the present disclosure, the second rod 48B and the second pair of pointers 56B will be described. The distance between the second fixed pointer 58B and the second variable pointer 60B is set to a reference measurement. For example, a selected distance on a subject 98 is measured using the second pair of pointers 56B. The calibration mechanism 68 is then engaged and the distance between the first fixed pointer 58A and the first variable pointer 60A is set to a desired distance corresponding to the desired dimension between the same two reference points to be transferred to the target medium 100, without adjusting the reference distance between the second fixed pointer 58B and the second variable pointer 60B.

In the illustrated embodiment, the calibration mechanism 68 includes a cooperating set of gears 70, 72, 74 disposed at the proximal end 14 of the housing 12. A first gear 70 is disposed on the proximal end 50A of the first rod 48A and a second gear 72 is disposed on the proximal end 50B of the second rod 48B. Specifically, the first and second gears 70, 72 are carried by the distal ends 38A, 38B of the first and second proximal end pins 34A, 34B, respectively. A third gear 72 is carried by the housing 12 and is disposed to cooperatively engage each of the first and second gears 70, 72. The third gear 74 is selectively disengageable from at least one of the first and second gears 70, 72. When the third gear 74 is engaged with each of the first and second gears 70, 72, when one of the first and second rods 48A, 48B is rotated, the other of the first and second rods 48A, 48B is rotated in the same direction and at the same rate. When the third gear 74 is disengaged from at least one of the first and second gears 70, 72, either of the first and second rods 48A, 48B is rotatable without imparting rotation on the other.

In the illustrated embodiment, each of the first, second, and third gears 70, 72, 74 is a conventional spur gear, having the same pitch diameter. A gear cover 82 is provided to enclose each of the first, second, and third gears 70, 72, 74. The gear cover 82 is shown as being mounted on the proximal end cap 26. The third gear 74 is carried on a shaft 76 having a proximal end 78 extending through a through opening 84 defined in the gear cover 82, and a distal end 80 extending through a third through opening 28C defined by the housing proximal end cap 26. An adjustment knob 86 is carried on the proximal end 78 of the shaft 76 and is provided for rotating the first and second rods 48A, 48B and for depressing the shaft 76 to disengage the third gear 74 from at least one of the first and second gears 70, 72. The shaft 76 is normally biased toward the gear cover 82 such that the third gear 74 is in engagement with each of the first and second gears 70, 72, as illustrated in FIG. 5A. In the illustrated embodiment, this is accomplished using a spring 88 disposed between the third gear 74 and the housing proximal end 14. In order to limit the travel of the shaft 76 toward the gear cover 82, a limit 90 is carried on or defined by the shaft 76 between the third gear 74 and the gear cover 82. However, it will be understood that the limit 90 may alternatively be disposed on the distal end 80 of the shaft 76 and on the interior side of the housing proximal end cap 26. When the adjustment knob 86 is depressed, the compression spring 88 is compressed, and when the adjustment knob 86 is released, the compression spring 88 expands to return the third gear 74 to engage both of the first and second gears 70, 72.

As discussed, when calibrating the linear proportioner 10, the third gear 74 is disengaged from at least one of the first and second gears 70, 72. In the illustrated embodiment, the third gear 74 always remains in engagement with the first gear 70. In this embodiment, due to the continuous engagement, when the third gear 74 is released to engage the second gear 72, the third gear 74 will always be in alignment. In order to accomplish disengagement with only the second gear 72, in the illustrated embodiment, the first gear 70 defines a thickness equal to the thickness of the second gear 72 plus the distance of travel of the third gear 74. The third gear 74 defines a thickness substantially equal to the thickness of the second gear 72. The length of travel of the third gear 74 is at least equal to the thickness of the second gear 72, thus allowing the disengagement of the second and third gears 72, 74. When the third gear 74 is disengaged from the second gear 72, as illustrated in FIG. 5B, the third gear 74 is rotated by rotating the adjustment knob 82 in order to rotate the first rod 48A independently of the second rod 48B.

Figure 6A:
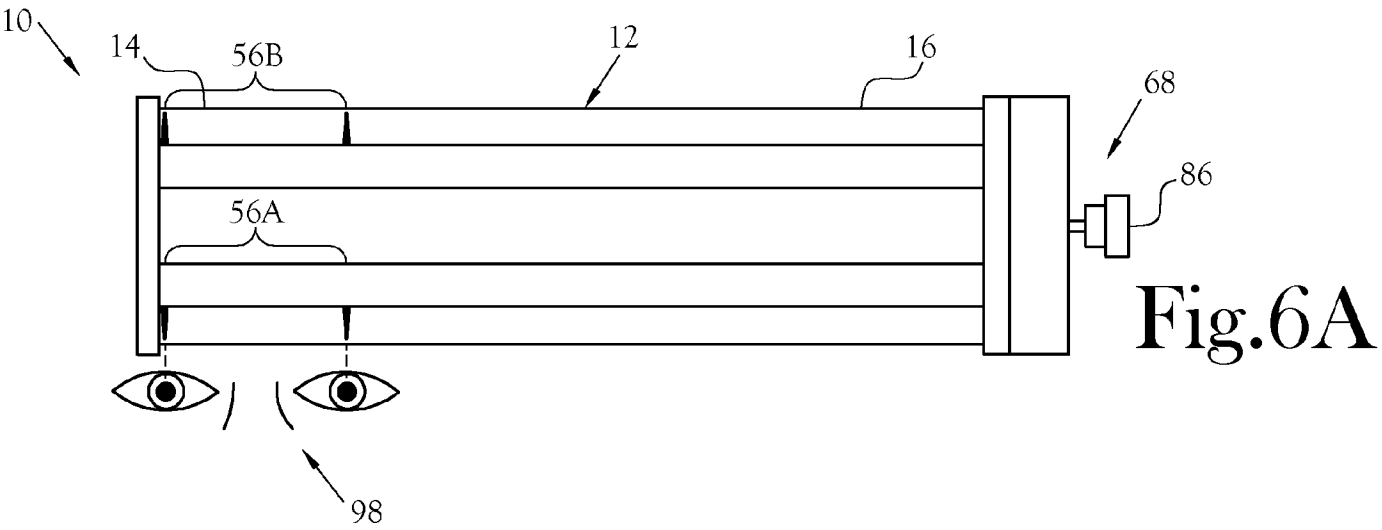
FIG. 6A is a plan view demonstrating the use of the linear proportioner of FIG. 1, illustrating the setting of the initial reference dimension performed by operating the adjustment know as illustrated in FIG. 4A.
Figure 6B:
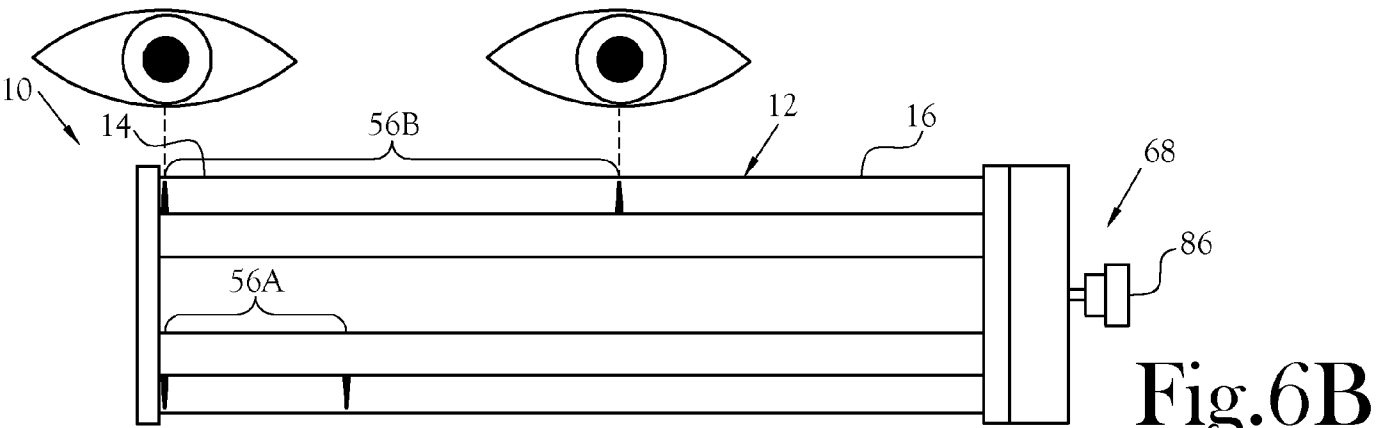
FIG. 6B is a plan view demonstrating the use of the linear proportioner of FIG. 1, illustrating the setting of the initial target dimension performed by operating the adjustment know as illustrated in FIG. 4B.
Figure 6C:
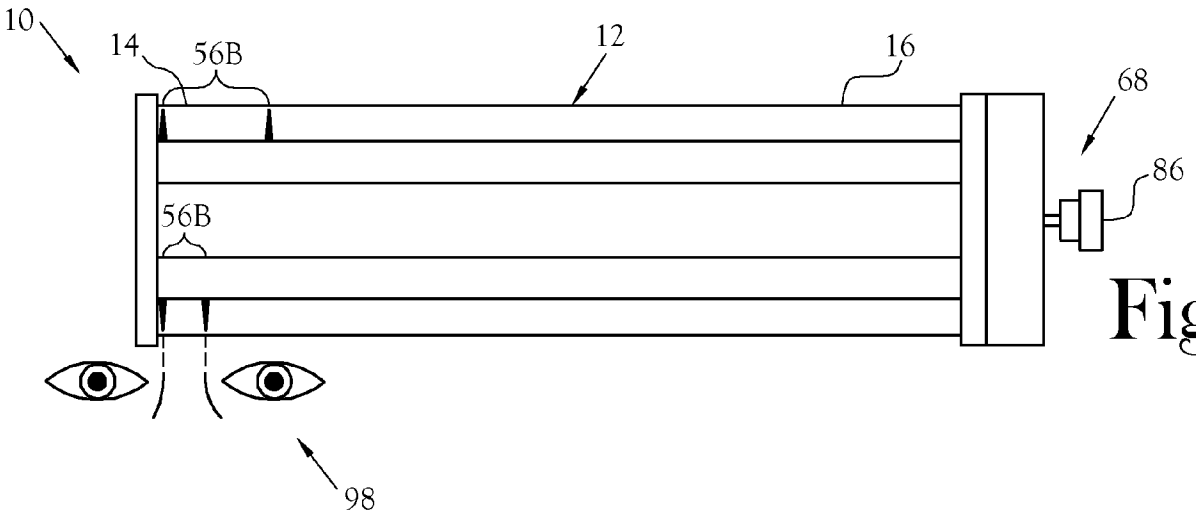
FIG. 6C is a plan view demonstrating the use of the linear proportioner of FIG. 1, illustrating the setting of a second reference dimension and therefore a second target dimension performed by operating the adjustment know as illustrated in FIG. 4A.
Figure 6D:
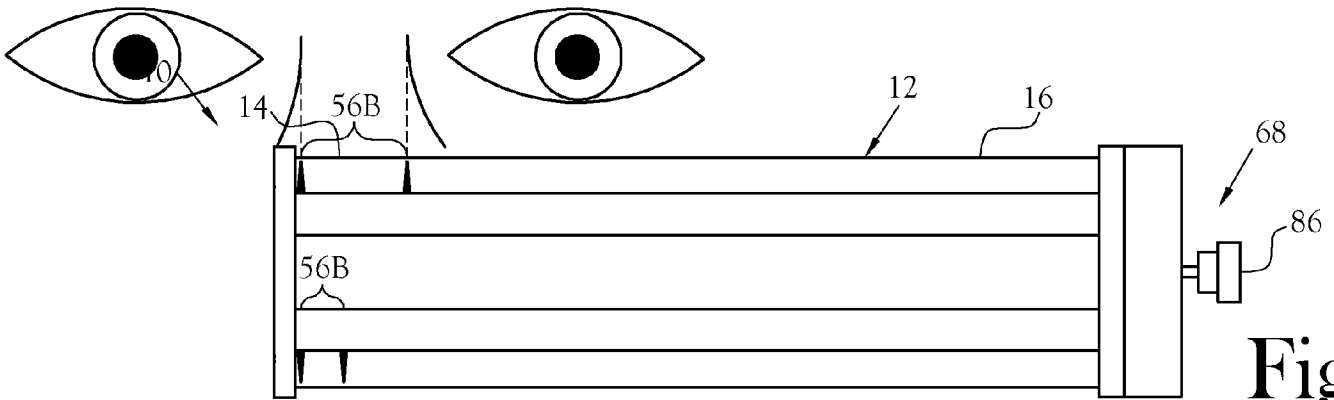
FIG. 6D is a plan view demonstrating the use of the linear proportioner of FIG. 1, illustrating the transfer of the second target dimension.

Thus, in order to calibrate the illustrated embodiment of the linear proportioner 10, the reference measurement is set on the second pair of pointers 56B by rotating the adjustment knob 82, as illustrated in FIG. 6A. In this illustration, a first reference measurement is taken between the center of a subject's eyes. As illustrated in FIG. 6B, the adjustment knob 82 is then depressed and then rotated in order to set the distance between the first pair of pointers 56A to the target measurement. The adjustment knob 82 is then released. In the illustration, the distance between the eyes is transferred to the target medium and the eyes are drawn. For subsequent measurements, as illustrated in FIG. 6C, the distance between the second pair of pointers 56B is set to the measurement between any two points on the subject 98 by rotating the adjustment knob 82. In this illustration, the distance between two points on the subject's nose is measured. The distance between the first pair of pointers 56A is then transferred to the target medium 100, as illustrated in FIG. 6D, the proportion between the subsequent reference and target measurements being the same as the proportion between the initial reference and target measurement. In this illustration, the distance between two points on the subject's nose is measured in FIG. 6C and then transferred to FIG. 6D. If the variable pointers 60A, 60B are positioned at the same distance from the respective fixed pointers 58A, 58B, then they will move at the same rate and will track each other. If the first variable pointer 60A is at x=1 and the second variable pointer 60B is at x=2, then when the knob 82 is rotated so the first variable pointer 60A is at x=5, the second variable pointer 60B is at x=10. The pointers 60A, 60B maintain a constant ratio, multiplication or proportion independent of "x" or the horizontal position.

In practice, an artist, without thinking about ratios, mathematics or actual dimensions, can set one pair of pointers 56 to a reference object 98, depress the adjustment knob 82, and set the other pair of pointers 56 to a desired position on the target medium 100. This is a one step calibration process and the ratio of proportion is arbitrary. After releasing the adjustment knob 82, the adjustment knob 82 is rotated to align the reference pointers 56B to a distance of interest and the object pointers 56A will automatically provide the desired expansion or reduction of that distance. For complex pictures where numerous transfers are desired, cross-hairs can be aligned over the picture and drawn on the target medium 100 to provide an overview reference.

In order to move each of the variable pointers 60A, 60B, each engages its respective rod 48A, 48B. Referring to each of FIGS. 3, 4A and 4B, in the illustrated embodiment, each of the pair of rods 48A, 48B defines a groove 54A, 54B dimensioned to closely and slidably receive a respective variable pointer bearing pin 62A, 62B and encircling the rod 48A, 48B and traversing the length of the rod 48A, 48B in spiral fashion. The groove 54A, 54B is a graphical representation of the function N[ln x] superimposed about the cylindrical surface of each of the pair of rods 48A, 48B, where N is a constant, ln is the natural log function, and x is the distance along the length of the rod 48A, 48B.

Although a particular engagement configuration is described and illustrated, it will be understood that other engagement configurations may be used as well to move the variable pointer 60 relative to the fixed pointer 58. One such configuration contemplated, although not illustrated, is a magnetic strip encircling each rod 48 in the same configuration as the groove 54. In this embodiment, the variable pointer 60 has a magnetic property at least in the portion of the variable pointer 60 proximate the magnetic strip. Thus, as the rod 48 rotates, the magnetic portion of the variable pointer 60 is moved along the channel 18.

More specifically to the configuration of each groove 54, the logarithm law utilized is:

$$\ln(ab)=\ln(a)+\ln(b).$$

The product of (a) and (b) is determined by obtaining the antilog of the sum of ln(a) and ln(b). In the following discussion, the reference distance is referred to as the variable "R" and the target or object distance is referred to as the variable "O". "X" is a multiplier or ratio between the reference 98 and the target 100, or $$O=(X)(R).$$

The natural log of "R" is represented by the configuration of the groove 54B of the second rod 48B at the point where the second variable pointer 60B is positioned with respect to the second rod 48B. Similarly, the natural log of "O" is represented on the groove 54A of the first rod 48A at the point where the first variable pointer 60A is positioned with respect to the first rod 48A. Using the above formula, $$\ln(O)=\ln(X)+\ln(R).$$

The value of "X" is determined when presetting the initial values $O_i$ and $R_i$ at initial calibration as described above. In short, the initial reference measurement $R_i$ is set by turning the adjustment knob 82, the adjustment knob 82 then being depressed and rotated to set the initial object measurement $O_i$. The multiplication factor is determined by:

$$X_i=O_i/R_i.$$

When the adjustment knob 82 is released, a subsequent reference measurement $R_s$ of interest on the reference drawing 98 can be set. Because both rods turn at the same rate, the natural log of $O_s$ is the sum of its previous value, $\ln(O_i)$, plus the advancement of the second rod 48B, or $[\ln(R_s)-\ln(R_i)]$ or:

$$\ln(O_s)=\ln(O_i)+\ln(R_s)-\ln(R_i) \quad (1)$$

Using another logarithmic law:

$$\ln(O_i)-\ln(R_i)=\ln(O_i/R_i) \quad (2)$$

Combining 1 and 2:

$$\ln(O_s)=\ln(O_i/R_i)+\ln(R_s) \quad (3)$$

By definition:

$$X_i=O_i/R_i \quad (4)$$

Combining 3 and 4:

$$\ln(O_s)=\ln(X_i)+\ln(R_s) \quad (5)$$

Similarly for any $R_n$:

$$\ln(O_n)=\ln(O_i)+\ln(R_n)-\ln(R_i) \quad (6)$$

$$\ln(O_n)=\ln(O_i/R_i)+\ln(R_n) \quad (7)$$

$$\ln(O_n)=\ln(X_i)+\ln(R_n) \quad (8)$$

Finally:

$$O_n=(X_i)(R_n) \quad (9)$$

The linear proportioner 10 transfers any value reference distance "R" to the respective object distance "O" using the relationship O=(X)(R) where X is the multiplication factor established at calibration.

The dynamic range of the linear proportioner 10 depends on the diameter of each of the rods 48 and the constant N in the formula y=N[ln(x)]. In the rectangular coordinate system, y is the vertical distance and x is the horizontal distance. Similarly, the distance along the length of the rods 48 is x and the distance traversed about the circumference of the rods 48 is y. The slope of the groove 54 is N[/1/x] as determined by taking the first derivative. The worst case slope of the groove 54 to facilitate easy movement of the variable indicators is equal to or greater than 45°, or 1 on the ln scale. For example, if the dynamic range is 10 inches (x=10), then the slope is N[1/10]. For the slope to equal 1, N=10. The minimum diameter of each rod 48 is determined by calculating the minimum practical spacing between the first two groove revolutions.

The above detailed description is based on identical rods 48. However, although not illustrated, it will be understood that the first and second rods 48A, 48B can be different in size and/or have a different logarithmic curve by varying the value of N. N in the formula N[ln(x)] can be increased to expand the dynamic range of either of the first and second rods 48A, 48B. Where the first and second rods 48A, 48B define different values of N, the gear ratio between the first and second rods 48A, 48B is adjusted to compensate for the difference in N between the two rods 48A, 48B. This adjustment of the gear ratio assures that the rods 48A, 48B track such that if their initial settings are equal, they will remain equal with all positions of the adjustment knob 82. It should be noted that increases of N may reduce the groove spacing close to zero, reducing the minimum distance capability. However, this reduction in minimum distance is typically not of concern when the first rod 48A is exploding the reference drawing or picture.

From the foregoing description, it will be recognized by those skilled in the art that a linear proportioner using logarithmic functions has been provided. The linear proportioner is provided for transferring dimensions from a subject graphic to a target medium. Using the configuration and the functionality of the present invention, dimensions are proportioned, expanded or reduced, using the natural logarithm function. The distance between two points on the subject is measured and an accurate proportion is then transferred to the medium.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. A linear proportioner for transferring dimensions from a subject graphic to a medium, said linear proportioner comprising:

an elongated housing defining first and second channels;

first and second rods pivotally mounted with said first and second channels, respectively, said first rod and said second rod being normally engaged such that as one of said first and second rods is rotated through a selected degree of rotation, the other of said first and second rods is rotated through an equivalent degree of rotation, said first and second rods being selectively disengaged such that as one of said first and second rods is rotated, the other of said first and second rods is not rotated;

first and second pairs of pointers, said first pair of pointers including a first fixed pointer and a first variable pointer, said first fixed pointer being fixed at one end of said first rod, and said first variable pointer being movable along the length of said first rod as said first rod is rotated, said second pair of pointers including a second fixed pointer and a second variable pointer, said second fixed pointer being fixed at one end of said second rod, and said second variable pointer being movable along the length of said second rod as said second rod is rotated, said first variable pointers being moved along said first rod a first distance and said second variable pointer being moved along said second rod a second distance when said first and second rods are engages, said first and second distances being proportional to one another;

a calibration mechanism for adjusting the proportionality of travel of said first and second variable pointers, said calibration mechanism including a mechanism for selectively disengaging said first and second rods from each other and for independently rotating one of said first and second rods, said proportionality of travel being determined by a ratio of a reference measurement set on one of said first and second rods between one of said first and second pairs of pointers and a target measurement set on the other of said first and second rods between the other of said first and second pairs of pointers.

2. The linear proportioner of claim 1 wherein each of said first and second variable pointers is engaged with each of said first and second rods, respectively, each of said first and second rods defining a groove traversing the length of said first and second rods in a spiral fashion representing the function N[ln x] where N is a constant, "ln" is the natural log function, and x is the distance along the length of said first and second rods;

wherein each of said first and second variable pointers includes a bearing pin configured to be received within said groove, a guide, and an extended portion defining a visible portion in alignment with a cooperating one of said first and second fixed pointers; and wherein each of said first and second housing channels defines a rod channel configured to rotatably receive each of said first and second rods, respectively, a guide channel for slidably receiving said variable pointer in order to limit travel of said variable pointer in a direction parallel to a longitudinal axis of each of said first and second rods, and a pointer channel for receiving said variable pointer extended portion; said rod channel, said guide channel and said pointer channel being interconnected;

whereby, as one of said first and second rods is rotated, said bearing pin of a corresponding one of said variable pointers is moved linearly along the longitudinal axis of said one of said first and second rods as limited by said guide slot, said variable pointer being moved linear as a rate defined by the natural logarithm function, whereby as both of said first and second rods are rotated, both of said first and second variable pointers are moved a distance proportionally to each other.

3. The linear proportioner of claim 1 wherein said calibration mechanism includes:

a first gear carried by a proximal end of said first rod;

a second gear carried by a proximal end of said second rod;

a third gear configured to normally engage each of said first and second gears and selectively disengaged from at least one of said first and second gears; and an adjustment knob engaged with said third gear for selectively disengaging said third gear from at least one of said first and second gear, and for rotating said third gear in order to impart rotation on at least one of said first and second gears;

whereby, when said third gear is engaged with each of said first and second gears and said adjustment knob is rotated, equal rotation is imparted on each of said first and second rods, thereby moving each of said first and second variable pointers; and whereby, when said adjustment knob is engaged to disengage said third gear from one of said first and second gears and said adjustment knob is rotated, rotation is imparted on one of said first and second rods without rotating the other of said first and second rods.

4. The linear proportioner of claim 1 wherein said elongated housing defines first and second windows for viewing each of said first and second pairs of pointers, respectively.

5. The linear proportioner of claim 1 wherein said elongated housing defines first and second windows for viewing each of said first and second pairs of pointers, respectively.

6. A linear proportioner for transferring dimensions from a subject graphic to a medium, said linear proportioner comprising:

an elongated housing defining first and second channels;

first and second rods pivotally mounted with said first and second channels, respectively, said first rod and said second rod being normally engaged such that as one of said first and second rods is rotated through a selected degree of rotation, the other of said first and second rods is rotated through an equivalent degree of rotation, said first and second rods being selectively disengaged such that as one of said first and second rods is rotated, the other of said first and second rods is not rotated;

first and second pairs of pointers, said first pair of pointers including a first fixed pointer and a first variable pointer, said first fixed pointer being fixed at one end of said first rod, and said first variable pointer being engaged with and movable along the length of said first rod as said first rod is rotated, said second pair of pointers including a second fixed pointer and a second variable pointer, said second fixed pointer being fixed at one end of said second rod, and said second variable pointer being engaged with and movable along the length of said second rod as said second rod is rotated, said first variable pointers being moved along said first rod a first distance and said second variable pointer being moved along said second rod a second distance when said first and second rods are engages, said first and second distances being proportional to one another, each of said first and second variable pointers being engaged with each of said first and second rods, respectively;

wherein each of said first and second rods defines a groove traversing the length of said first and second rods in a spiral fashion representing the function N[ln x] where N is a constant, "ln" is the natural log function, and x is the distance along the length of said first and second rods;

wherein each of said first and second variable pointers includes a bearing pin configured to be received within said groove, a guide, and an extended portion defining a visible portion in alignment with a cooperating one of said first and second fixed pointers; and wherein each of said first and second housing channels defines a rod channel configured to rotatably receive each of said first and second rods, respectively, a guide channel for slidably receiving said variable pointer in order to limit travel of said variable pointer in a direction parallel to a longitudinal axis of each of said first and second rods, and a pointer channel for receiving said variable pointer extended portion; said rod channel, said guide channel and said pointer channel being interconnected;

whereby, as one of said first and second rods is rotated, said bearing pin of a corresponding one of said variable pointers is moved linearly along the longitudinal axis of said one of said first and second rods as limited by said guide slot, said variable pointer being moved linear as a rate defined by the natural logarithm function, whereby as both of said first and second rods are rotated, both of said first and second variable pointers are moved a distance proportionally to each other;

a calibration mechanism for adjusting the proportionality of travel of said first and second variable pointers, said calibration mechanism including a mechanism for selectively disengaging said first and second rods from each other and for independently rotating one of said first and second rods, said proportionality of travel being determined by a ratio of a reference measurement set on one of said first and second rods between one of said first and second pairs of pointers and a target measurement set on the other of said first and second rods between the other of said first and second pairs of pointers, wherein said calibration mechanism includes:

a first gear carried by a proximal end of said first rod;

a second gear carried by a proximal end of said second rod;

a third gear configured to normally engage each of said first and second gears and selectively disengaged from at least one of said first and second gears; and an adjustment knob engaged with said third gear for selectively disengaging said third gear from at least one of said first and second gear, and for rotating said third gear in order to impart rotation on at least one of said first and second gears;

whereby, when said third gear is engaged with each of said first and second gears and said adjustment knob is rotated, equal rotation is imparted on each of said first and second rods, thereby moving each of said first and second variable pointers; and whereby, when said adjustment knob is engaged to disengage said third gear from one of said first and second gears and said adjustment knob is rotated, rotation is imparted on one of said first and second rods without rotating the other of said first and second rods.

7. A method for transferring dimensions from a subject graphic to a medium, using a linear proportioner comprising:

an elongated housing defining first and second channels;

first and second rods pivotally mounted with said first and second channels, respectively, said first rod and said second rod being normally engaged such that as one of said first and second rods is rotated through a selected degree of rotation, the other of said first and second rods is rotated through an equivalent degree of rotation, said first and second rods being selectively disengaged such that as one of said first and second rods is rotated, the other of said first and second rods is not rotated;

first and second pairs of pointers, said first pair of pointers including a first fixed pointer and a first variable pointer, said first fixed pointer being fixed at one end of said first rod, and said first variable pointer being engaged with and movable along the length of said first rod as said first rod is rotated, said second pair of pointers including a second fixed pointer and a second variable pointer, said second fixed pointer being fixed at one end of said second rod, and said second variable pointer being engaged with and movable along the length of said second rod as said second rod is rotated, said first variable pointers being moved along said first rod a first distance and said second variable pointer being moved along said second rod a second distance when said first and second rods are engages, said first and second distances being proportional to one another, each of said first and second variable pointers being engaged with each of said first and second rods, respectively;

wherein each of said first and second rods defines a groove traversing the length of said first and second rods in a spiral fashion representing the function N[ln x] where N is a constant, "ln" is the natural log function, and x is the distance along the length of said first and second rods;

wherein each of said first and second variable pointers includes a bearing pin configured to be received within said groove, a guide, and an extended portion defining a visible portion in alignment with a cooperating one of said first and second fixed pointers; and wherein each of said first and second housing channels defines a rod channel configured to rotatably receive each of said first and second rods, respectively, a guide channel for slidably receiving said variable pointer in order to limit travel of said variable pointer in a direction parallel to a longitudinal axis of each of said first and second rods, and a pointer channel for receiving said variable pointer extended portion; said rod channel, said guide channel and said pointer channel being interconnected;

whereby, as one of said first and second rods is rotated, said bearing pin of a corresponding one of said variable pointers is moved linearly along the longitudinal axis of said one of said first and second rods as limited by said guide slot, said variable pointer being moved linear as a rate defined by the natural logarithm function, whereby as both of said first and second rods are rotated, both of said first and second variable pointers are moved a distance proportionally to each other;

a calibration mechanism for adjusting the proportionality of travel of said first and second variable pointers, said calibration mechanism including a mechanism for selectively disengaging said first and second rods from each other and for independently rotating one of said first and second rods, said proportionality of travel being determined by a ratio of a reference measurement set on one of said first and second rods between one of said first and second pairs of pointers and a target measurement set on the other of said first and second rods between the other of said first and second pairs of pointers, wherein said calibration mechanism includes:

a first gear carried by a proximal end of said first rod;

a second gear carried by a proximal end of said second rod;

a third gear configured to normally engage each of said first and second gears and selectively disengaged from at least one of said first and second gears; and an adjustment knob engaged with said third gear for selectively disengaging said third gear from at least one of said first and second gear, and for rotating said third gear in order to impart rotation on at least one of said first and second gears;

whereby, when said third gear is engaged with each of said first and second gears and said adjustment knob is rotated, equal rotation is imparted on each of said first and second rods, thereby moving each of said first and second variable pointers; and whereby, when said adjustment knob is engaged to disengage said third gear from one of said first and second gears and said adjustment knob is rotated, rotation is imparted on one of said first and second rods without rotating the other of said first and second rods;

said method comprising the steps of:

a) rotating said adjustment knob to set a reference dimension between one of said first and second pairs of pointers, said one of said first and second pairs of pointers being selected as corresponding to one of said first and second gears which is selectively disengaged from said third gear;

b) engaging said adjustment knob to disengage said third gear from said one of said first and second gears;

c) rotating said adjustment knob to set a target dimension between the other of said first and second pairs of pointers;

d) marking said target dimension on said target medium;

e) rotating said adjustment knob to set a subsequent reference dimension between said one of said first and second pairs of pointers, said other of said first and second variable pointers being moved a distance proportional to a distance traveled by said one of said variable pointers to establish a subsequent target dimension between the other of said first and second pairs of pointers;

f) marking said subsequent dimension on said target medium; and g) repeating steps e) and f) to proportionally transfer all reference dimensions to said target medium as target dimensions.

* * * * *